US011029108B1

(12) United States Patent
Tal et al.

(10) Patent No.: US 11,029,108 B1
(45) Date of Patent: Jun. 8, 2021

(54) MAGAZINE LOADER WITH COUPLED TOP AND FRONT ROUND PUSHERS

(71) Applicant: Guy Tal, Rosh Ha'Ayin (IL)

(72) Inventors: Ran Tal, Tel Aviv (IL); Guy Tal, Rosh Ha'Ayin (IL)

(73) Assignee: Maglula, Ltd., Rosh Ha'ayn (IL)

( * ) Notice: Subject to any disclaimer, the term of this patent is extended or adjusted under 35 U.S.C. 154(b) by 0 days.

(21) Appl. No.: 16/900,968

(22) Filed: Jun. 14, 2020

Related U.S. Application Data

(60) Provisional application No. 62/864,120, filed on Jun. 20, 2019.

(51) Int. Cl.
*F41A 9/83* (2006.01)
*F41A 9/66* (2006.01)
*F41A 9/62* (2006.01)

(52) U.S. Cl.
CPC *F41A 9/83* (2013.01); *F41A 9/66* (2013.01); *F41A 9/62* (2013.01)

(58) Field of Classification Search
CPC ..... F41A 9/66; F41A 9/82; F41A 9/83
See application file for complete search history.

(56) References Cited

U.S. PATENT DOCUMENTS 4,570,371 A * 2/1986 Mears ..... F41A 9/83 42/87
5,249,386 A * 10/1993 Switzer ..... F41A 9/83 42/87
7,637,048 B2 * 12/2009 Tal ..... F41A 9/83 42/87
8,776,419 B2 7/2014 Obermeit
9,976,826 B2 * 5/2018 Hefer ..... F41A 9/83
10,539,383 B1 * 1/2020 Tal ..... F41A 9/83
10,598,456 B1 * 3/2020 Tal ..... F41A 9/83
2017/0211902 A1 * 7/2017 Mills ..... F41A 9/83
2018/0202735 A1 * 7/2018 Draper ..... F41A 9/82
2020/0158454 A1 * 5/2020 Oross ..... F41A 9/83

OTHER PUBLICATIONS https://americanspeedloaders.com/product/pmr-30-kel-tec-22wmr-double-action.
https://americanspeedloaders.com/product/pmr-30-cmr-30.
https://americanspeedloaders.com/product/kel-tec-pmr-30-single-action.
https://www.makershot.com/speedloaders/kel-tec-pmr-30-22-wmr-magazine-speedloader.

* cited by examiner

*Primary Examiner* — Gabriel J. Klein
(74) *Attorney, Agent, or Firm* — David Pressman

(57) ABSTRACT

A device for assisting loading rounds into a firearm magazine (70) includes a body (12) that locks to the magazine using a catch pin 16. The body has a top opening (32) for a round (74). A press (40) hinged to the body top includes two plungers (44, 46) projecting down and aligned to enter the opening. A bullet pusher (60) is hinged to the body front and has a tongue (68) with a pushing surface (64). A wire (54) couples the press and pusher so that when the press is moved down, the pusher is moved out, and vice versa. A round is placed in the opening and on the tongue and the press is moved down to withdraw the tongue and push the round partly into the magazine. The pusher is then moved to the body to raise the press and push the round fully into the magazine.

20 Claims, 5 Drawing Sheets

MAGAZINE LOADER WITH COUPLED TOP AND FRONT ROUND PUSHERS

BACKGROUND—CROSS-REFERENCE TO RELATED APPLICATION

This patent issued from an application that claims priority of Provisional Patent Application Ser. No. 62/864,120, Filed 2019 Jun. 20.

BACKGROUND—PRIOR ART

Small firearms, including pistols, assault rifles, and submachine guns, utilize and fire rounds (also known as cartridges and ammunition). Each round is substantially elongated and comprises a deep cylindrical cuplike case (also known as a shell, casing, and sometimes a cartridge), usually of brass, which is filled with an explosive propellant. At its rear or closed end, the case has a rim or flange containing a primer; the front and opposite end of the case as manufactured is open. A bullet, slug, or head, usually of lead (optionally jacketed) is partly inserted into the open or front end of the case, where after the case is crimped onto the bullet to secure it in the case.

Firearm magazines usually hold a plurality of rounds and feed them into the firearm. Detachable magazines have become dominant throughout the world. The term 'magazine' is broad, encompassing several geometric variations, including box, curved, and drum magazines. Most detachable boxed and curved magazines are similar, varying in form and structure, rather than in their general principles of operation. Drum magazine usually store rounds differently than boxed and curved magazines. All magazines have a catch, usually a hole, dent, or protrusion, to enable locking and retention to a designated magazine-well of the firearm.

Non-drum magazines usually take the form of an elongated container having a generally rectangular cross-section which can be removably attached to the firearm. They are commonly made of aluminum alloys, plastic, steel, or a combination. They are usually closed on five sides and open on a sixth, upwardly facing, top, side, or end, and are substantially hollow. The top or open side includes two round-retaining members, known as feed or round-retaining lips. The magazines have an internal spring which urges a follower or pusher (a shaped piece of plastic or metal) straight up toward the open side. The follower in turn urges the rounds as a group up towards the lips. The lips act as a stop for the rounds so that they are not all expelled at once upwardly from the magazine, but can be pushed out one at a time by the firearm's extractor mechanism.

Some magazines, like the popular 30-round .22WMR (0.22 Magnum) magazines, are made by Kel-Tec CNC Industries Inc., of Cocoa Fla., and are sold under Kel-Tec's trademarks PMR-30 and CMR-30, and are shown in U.S. Pat. No. 8,776,419 to Obermeit, 2014 Jul. 15. These are non-drum magazines where rounds are double stacked in two vertical and parallel columns below the magazine's feed or retaining lips. The rounds are staggered so that each column is offset from each other. The longitudinal axes of the rounds are substantially parallel and perpendicular to the direction of travel of the spring and follower. Adjoining rounds are oriented in the same direction, i.e., the bullets of adjacent rounds are next to each other. These and some other magazines have space between the retaining lips which is smaller than the rim diameter of the round. Also, these magazines are designed so that only one of the two lips of the magazine hold the topmost round in place, rather than both lips (as in most pistol magazines). Thus the topmost round is held alternately by either the left or right lip.

Still further, the PMR/CMR magazines are uncommonly designed such that, in addition to retaining lips, the magazine also has retaining flaps (like miniature lips) which are narrower than the lips and extend forward as a continuation of the retaining lips and are spaced apart more than the retaining lips. The spacing between the lips and the spacing between the flaps is such that the rim of the round can pass freely between the flaps but not the lips. The topmost round can be loosely and temporarily retained at the open top of the magazine in-front of the retaining lips by the flaps. When the round is fully inserted, the follower urges it upward against the one lip and its flap so that the lip and its flap partly cover the case of the round sufficient to hold it in the magazine.

Prior to use, a firearm magazine must be loaded (charged or filled). When each round is loaded into the magazine, it is necessary to depress the follower and any previously loaded rounds to provide space below the lips so that an additional round can be inserted. Each time another round is loaded the spring is further compressed, requiring increased manual force by the user. When rounds are loaded with one's bare hands, the press-down force required increases as each additional round is loaded against the spring's force (which forces the rounds toward the lips). When a user loads a large number of rounds or many magazines the force required will cause finger pain, which will increase with the number of rounds and magazines loaded.

To load PMR/CMR magazines, described above, the user first places a new round, case (rim end) first and substantially perpendicular to the magazine, on top of the follower or on top of an already loaded round, in front of the retaining lips and between the flaps. The bullet of the round extends forward from the magazine. The user then uses a thumb to force down the new round, and hence all the round(s) below it, into the magazine to make sufficient space below one of the lips of the magazine for insertion of the new round in that space. The round is now in a partly inserted position. Then the user slides or pushes the round rearwardly into the vacant space below the lip to be retained by it in a final position. The lip and its flap partly cover the case of the round sufficient to keep it in the magazine. The user repeats this procedure by alternately inserting a round below each lip until the magazine is full. Hereafter the term 'magazine' will mean box-type magazines of the type described above that requiring a push-down and slide-back round loading where one lip retains the topmost round and where flaps or similar can hold the round partly in place in front of the retaining lips. As such, a new round must be forced down in front of the lips and then slid rearwards below one lip to be placed in final position.

Hand loading does not usually utilize a special magazine feature where a new round can be loosely retained in-front of the lips prior to rearwardly sliding into a vacant space below a retaining lip into its final position, like the PMR/CMR magazine described above.

To increase loading speed and decrease finger pain associated with loading magazines, several magazine loaders were developed, which will now be reviewed.

Non-Patent Literature

American Speedloaders, LLC of Caro, Mich., makes three different loaders for the PMR/CMR-30 magazines:

1. A 'Double Action' speed loader for the PMR/CMR-30 magazine, shown at https://americanspeedloaders.com/product/pmr-30-kel-tec-22wmr-double-action/, has a top horizontal slider for pushing down and sliding a topmost round rearwardly. The slider is coupled to a body which is not lockable to the magazine, but rather is vertically slidable on the top of the magazine. This loader has no leveraging means to ease the force of the magazine's spring to load rounds.

2. A 'Single Action' speed loader for the PMR/CMR-30 magazine, shown at https://americanspeedloaders.com/product/pmr-30-cmr-30/, is a single-part loader which is vertically slidable on the top of the magazine. It has a simple tooth for just pushing down the topmost round in front of the lips.

3. A 'Nest style' speed loader for the PMR/CMR-30 magazine applies friction and force against the curve of the bullet to make it slide into place in the magazine. Excessive force is required to push down the magazine to load a round. This loader has no leveraging means and is shown at https://americanspeedloaders.com/product/kel-tec-pmr-30-single-action/.

The above three loaders and all other prior-art magazine-lockable loaders which we are aware of are large and hence not pocketable, are complex and difficult to operate, and/or are not reliable in operation, i.e., they can get jammed. Also, they lack any leveraging means to ease the force required to load a round into a magazine and are hence inefficient and uncomfortable for repeated use.

The following additional simple single-part loaders also have no leveraging means to ease loading:

https://www.youtube.com/watch?v=BaKRx1KcKNO&feature=youtu.be https://www.youtube.com/watch?v=v_RTC5ApGXg https://www.makershot.com/speedloaders/kel-tec-pmr-30-22-wmr-magazine-speedloader Advantages Accordingly, several advantages of one or more aspects of our loader are to provide (a) a magazine-lockable loader with leveraging means for increased loading comfort and ease, (b) a simple mechanical mechanism for providing a low cost, pocket-size, lightweight loader, (c) a loader which has relatively few parts, is efficient, reliable, and comfortable to use, (d) a loader which does not get stuck and does not dent delicate .22WMR (or other cal.) case shells, and (e) a loader adapted to more easily load magazines of types like the Kel-Tec PMR/CMR-30 factory magazines. Further advantages of one or more aspects will become apparent from a consideration of the drawings and ensuing description.

SUMMARY

The present firearm magazine loader facilitates loading small-caliber loose ammunition rounds into a firearm magazine of the type requiring a round push-down to temporarily hold, slide-back loading action. It basically comprises, in one aspect adapted to load Kel-Tec's PMR/CMR30 magazines, a body designed to lock on top of a magazine, a tiltable top press coupled to the rear top of the body which includes a protruding round plunger, a tiltable front bullet-pusher coupled to the lower front of the body and coupled by wire or other means to the top press. The body is fitted and locked to the magazine with its protruding lock pin fitting in a magazine's side catch hole. A round is placed and the press, and its plunger is tilted down with leverage to push the round down to be temporarily locked in the magazine in front of the magazine's lips. The front bullet-pusher is then pushed to slide the round rearward below a lip while tilting up the press.

DRAWINGS—FIGURES

REFERENCE NUMERALS

Figure 1A:
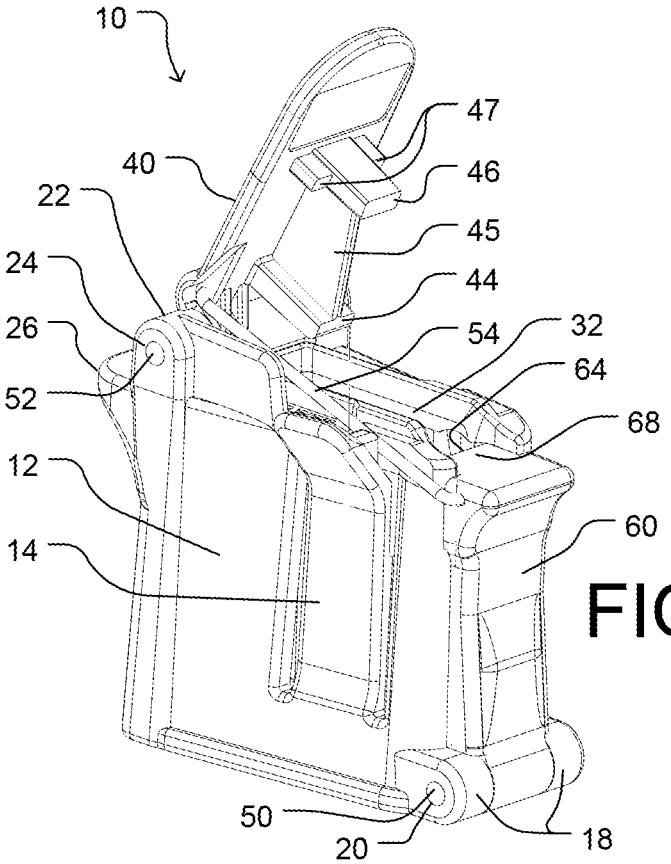
FIG. 1A is a perspective top left side view of a new magazine loader shown with its press in an 'up' position.

10 loader
12 body or holder
14 lock tongue
16 lock tooth
17 opening
18 lower support ears
20 lower hole(s)
22 upper support ears
24 upper hole(s)
26 rear hand support
28 securing hole
30 unloading tooth
32 opening
34 rear side of opening 32
40 press (rounds depressor holder)
42 axial hole
44 rear plunger (rear rounds depressor)
45 support rib
46 front plunger (front rounds depressor)
47 stop
48 press wire hole
50 lower pin
52 upper pin
54 coupling wire
60 front pusher
62 through hole
64 bullet pushing surface
66 front pusher wire hole
68 tongue
70 PMR/CMR magazine
70F top of front wall

71 round witness holes
72 lips of magazine
73 flaps of magazine
74 round of ammunition
76 case of round
78 bullet of round
80 rim of round

DETAILED DESCRIPTION—FIGS. 1A-1C

Figure 1C:
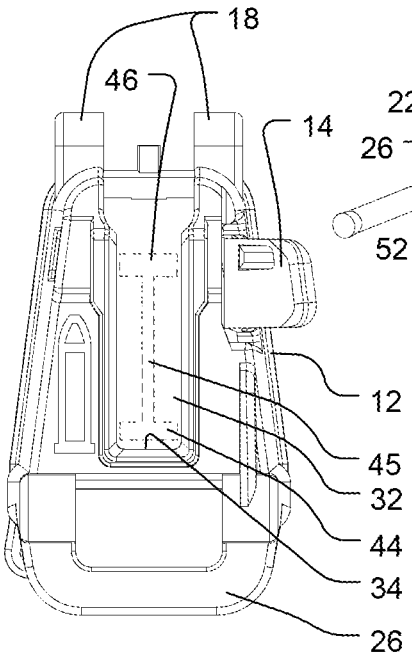
FIG. 1C is a top view of the body.
Figure 1B:
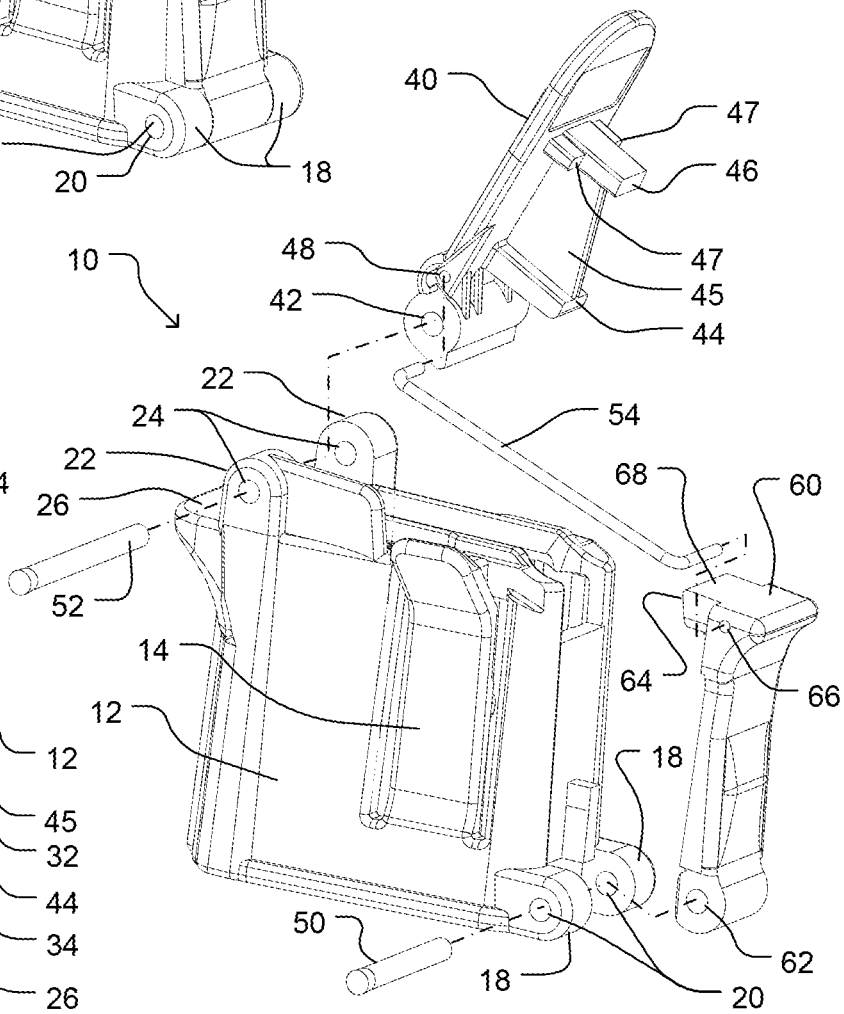
FIG. 1B is a perspective exploded top left side view of the loader.

FIG. 1A is a perspective top left side view of our magazine loader 10 arranged to fit and load rounds into Kel-Tec's PMR/CMR-30 .22WMR caliber factory magazines (FIGS. 3B-5B, element 70). FIG. 1B is an exploded view of the loader seen from the top left side and FIG. 1C is a top view of a body 12 of the loader.

Body: The loader basically comprises body or holder 12 defined by four connecting side-walls and an open bottom and a partly-open top. The four walls consist of a back wall, a front wall, and two side walls connecting said front and back walls to form a rectangle. It is sized and configured to fit over the top open end, or side, of magazine 70 (FIGS. 3B-5B). The body includes two upper support ears 22 extending upward from the top of the rear wall; each ear has a through hole 24 which is aligned with the other ear's through hole. The body also includes two lower support ears 18 extending forward from the bottom of the front wall; each ear has a through hole 20 which is aligned with the other ear's through hole.

Press: A tiltable top pusher or press 40 is hingedly coupled, at its rear or lower end, to and between support ears 22 by pin 52 (FIG. 1B) which extends through holes 24 and through hole 42 of the press. Press 40 has two opposite ends and a pair of opposite sides, one of which is an upper side facing away from the partly-open top of the body and one of which is an underside facing the partly-open top. Thus press 40 is pivotable or tiltable around pin 52, from its up position (FIGS. 1A & 2B) where it extends up from above and is angled to the partly-open top of the body. Its opposite end is relatively far from said body clockwise with respect to the body to its down position (FIG. 2C) where its opposite end is relatively close to the body.

The press has a relatively long plunger 44 extending from its underside at its lower inner end downward substantially perpendicular to the press's underside surface (not numbered). The press also has a shorter front plunger 46 further up the press extending substantially parallel to plunger 44, also extending from its underside. A thin support rib 45 extends between the plungers for strength. Two stops or blocks 47 sandwich the proximal end of front plunger 46; when the plunger is rotated down these stops engage the top of the body to provide means for limiting the extent of the downward rotation of the press.

Body 12 also includes body-locking or attaching means for removably attaching the body to the magazine. Such means comprises an outwardly flexible elastic magazine lock tongue 14 (FIG. 1A). Its vertical sides are detached from the body, as is its top, which is bent outwardly; its bottom end is integrally attached to and molded with the body. The inner side of the lock tongue contains a lock tooth or pin 16 (FIG. 3A) projecting into the body. The magazine (FIGS. 4A & 4B) has a series of inspection holes 71 ("witness holes" in firearm parlance) for enabling a user to determine how many rounds are in the magazine When the loader is slid over magazine 70 ((FIG. 4A) tooth 16 is designed and positioned to enter the topmost witness hole, so that this hole also serves as a holding hole for locking the loader to the magazine. Lock tongue 14 can be flexed outward by pulling its top end out; this will release lock tooth 16 from the witness hole. The body-locking means can comprise any other apparatus for removably attaching the body to the magazine.

Body 12 includes a rear hand support or grip 26 (seen best in FIGS. 2B and 3A) extending rearward from the top of the body to enable the user to grip the loader securely. The front of body 12 (FIGS. 1A-1B) also has two distal lower support ears 18 extending forward, each with a through hole 20.

Pusher: The loader has a front pusher 60 (best shown in FIGS. 2A-3C) which comprises a member having a pair of opposite ends, one of which is a lower end and the opposite end of which is an upper end. The pusher has an open position where it extends away from and is angled to the front wall of the body (FIG. 2C) so that its opposite, upper end is relatively far from the front wall, and a closed position (FIG. 3B) where its upper end is relatively close to the front wall. The pusher also has a pair of opposite sides, one of which is an outer side facing away from the front side of the body and one of which is an inner side facing the front side. The pusher further has a through hole 62 at its bottom hingedly coupled to the body adjacent a lower end of the front wall between ears 18 by pin 50, which extends through pusher 60 and holes 20 in ears 18.

Pusher 60 further has a projecting tongue 68 at its upper end that extends from the inner side of the pusher adjacent its upper end. The tongue has a free end that is spaced from a topmost round in said magazine when the pusher is in its open position and past the front wall and into the open end of the magazine so that it can engage and push an end of a topmost round in the magazine when the pusher is moved to the closed position. The tongue has a substantially vertical bullet-pushing surface 64 (better seen in FIGS. 4B and 5B) pointing towards and slightly entering an opening 32 of the body. Pusher 60 further has a side hole 66 (FIG. 1B) extending into its upper left side. The pusher is tiltable with respect to the body around pin 50.

A metal wire 54 (FIGS. 1A, 1B, 2A-2C, 3B & 3C) with a 90° bend at each end couples the press and front pusher by extending into hole 48 in the press, located above hinging holes 42 and hole 66 in the front pusher. The wire serves as means for coupling the press to the pusher so that movement of the press from its up position to its down position will move the pusher from its closed position to its open position. Conversely, when the pusher is moved from its open position to its closed position the means for coupling will move the press from its down position to its up position. Hence, when press 40 is pressed down, it moves wire 54 forward, thereby tilting pusher 60 frontward, away from the body. When pusher 60 is pushed back to the body, it moves wire 54 backward, causing press 40 to be tilted back upward again. The means for coupling can alternatively be realized by two wires, or members with other shapes, or by any other suitable coupling mechanism.

Figure 4A:
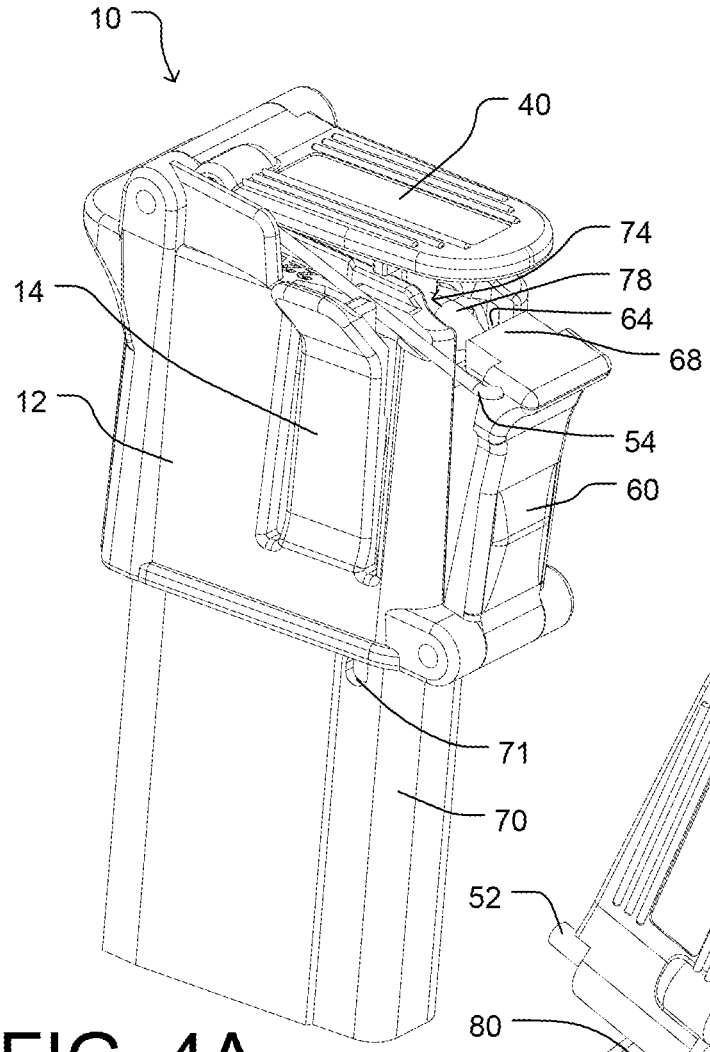
FIG. 4A is a perspective top left side view of the loader on the magazine with its press tilted to a 'down' position.
Figure 4B:
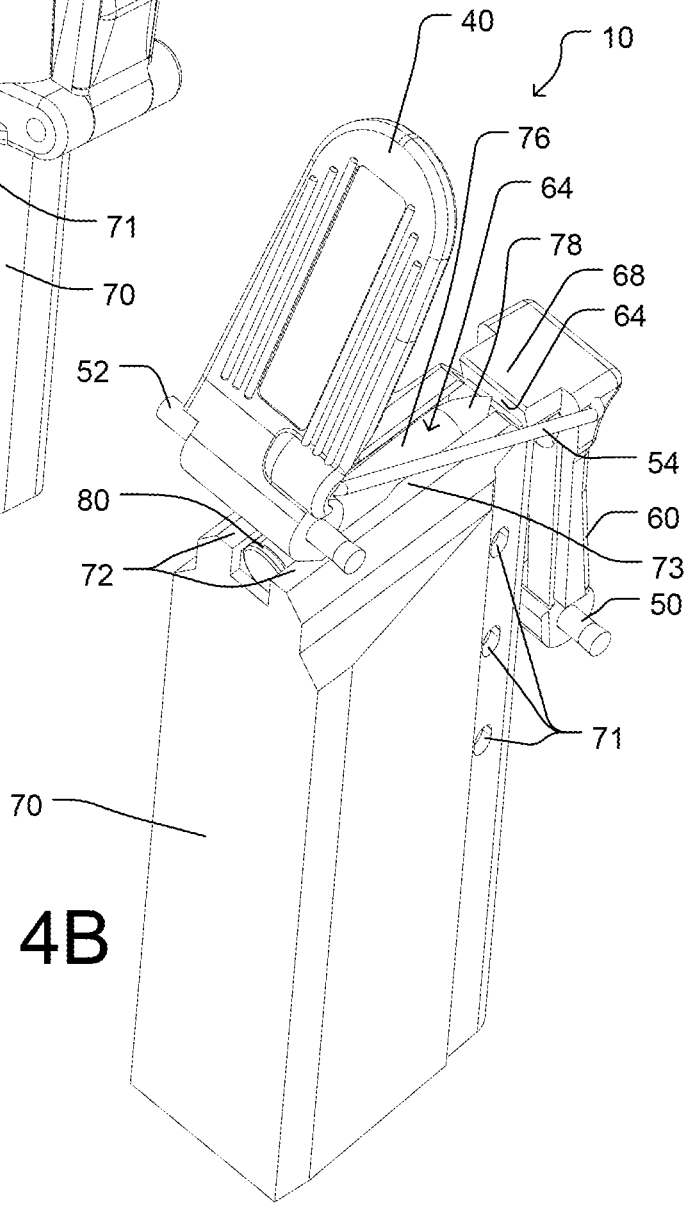
FIG. 4B is a perspective top rear side view of the loader, less its body, with its press in an 'up' position.
Figure 5A:
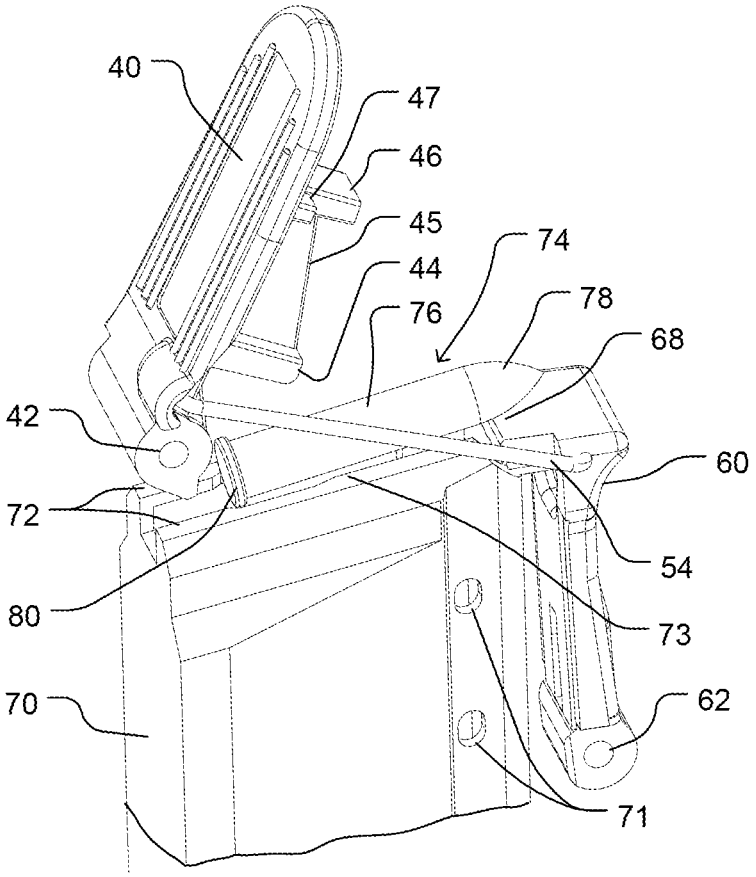
FIG. 5A is another perspective top left side view of the loader on the magazine with its press in 'up' position omitting the body.
Figure 5B:
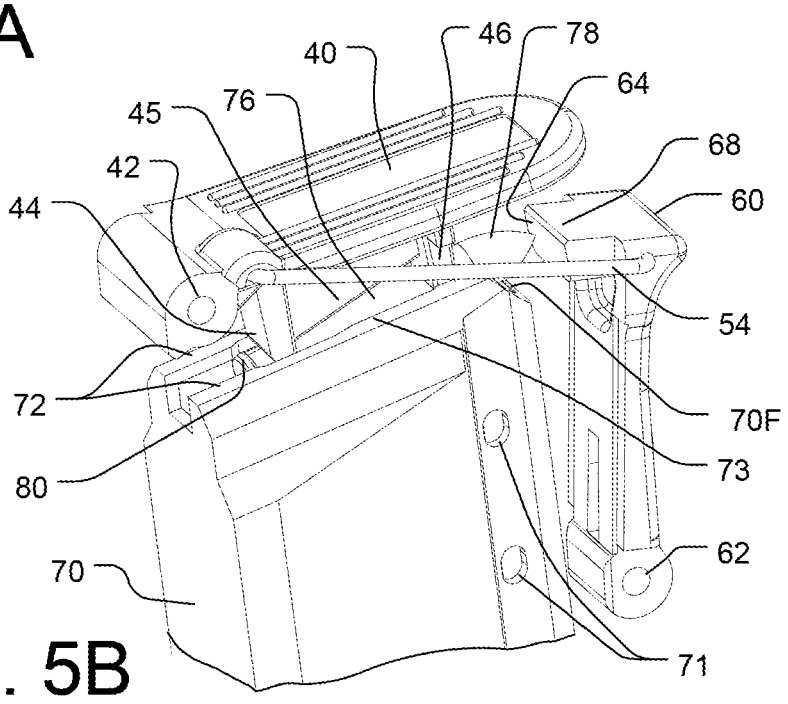
FIG. 5B is another perspective top left side view of the loader on the magazine with its press in fully 'down' position omitting the body.

FIG. 1C is a top view of the body showing substantially rectangular through opening 32 at the top having a rear side 34. Opening 32 is centered in the body (right & left). Plungers 44 and 46 of press 40 are not visible from the top as they are under press 40 but are shown in hidden lines in FIG. 1C. The plungers are sized to pass through opening 32 when press 40 is pushed to a 'down' position (FIG. 2C). Plungers 44 and 46 are narrower than the distance between magazine lips 72 (FIGS. 4B, 5A-5B). FIG. 1C illustrates, in broken lines, plunger 44 positioned adjacent rear side 34 of opening 32 when the press is fully down (FIG. 2C, 4A, 5B). Rear side 34 is designed to be positioned just forward of lips 72 (FIG. 5B) of the magazine, and plunger 44 is designed to be just forward of rear side 34, as illustrated in FIG. IC.

The loader's body, press, and front pusher are preferably made of durable glass-fibered polymer material, such as polyamide-6, and produced by plastic injection molding. Wire 54 is preferably made of spring wire or stainless-steel wire and the two pins are preferably made of metal for strength.

Figure 2A:
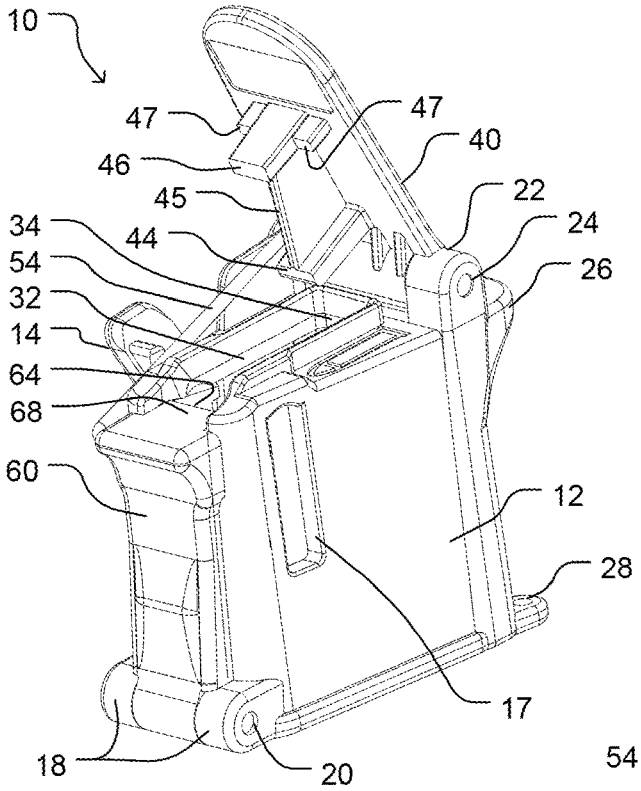
FIG. 2A is a perspective top-right side view of the loader shown with its press in an 'up' position.
Figure 2B:
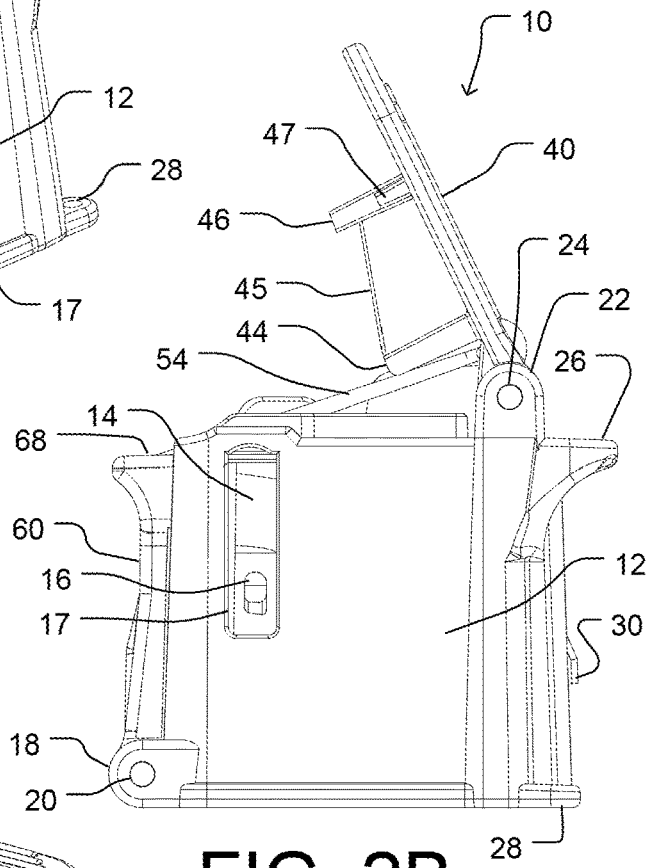
FIG. 2B is a right-side view of the loader with its press in an 'up' position.
Figure 2C:
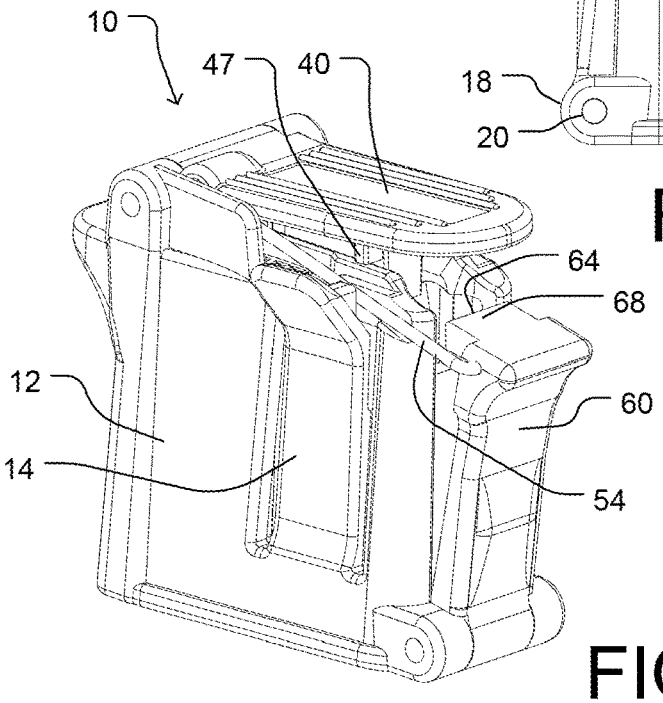
FIG. 2C is a perspective top left side view of the loader shown with its press in a 'down' position.

FIGS. 2A-2C—Perspective Views

FIG. 2A is a perspective top right-side view of the loader shown with its press 40 in the 'up' position. Body 12 includes a technical through hole 17 in the right-side wall in order to be able to form lock tooth 16 by the plastic injection molding process. At the bottom of the loader a rearwardly extending tab has a through hole 28 to tie a string or metal ring to secure the loader against loss. FIG. 2B is a right-side view of the loader with its press fully up. Coupling wire 54 is long enough and positioned to cause front pusher 60 to be substantially parallel to—or be in a near-most position to—the body. Lock tooth 16 (FIG. 3A) is shown extending inward from lock tongue 14. The rear side-wall of the loader (FIG. 3A) has a projecting unloading tooth 30, which is used to extract a topmost round from the magazine.

FIG. 2C is a perspective top left side view of the loader shown with its press in a fully 'down' position where coupling wire 54 tilts pusher 60 to its furthest or away position from the body. Tongue 68 and its pushing surface 64 are retracted maximally from opening 32 and the body.

Figure 3A:
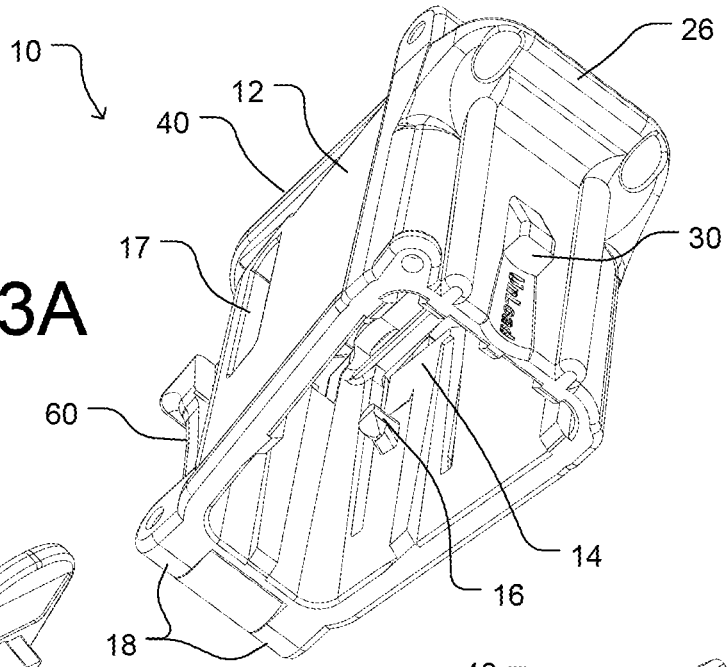
FIG. 3A is a perspective bottom view of the loader.
Figure 3B:
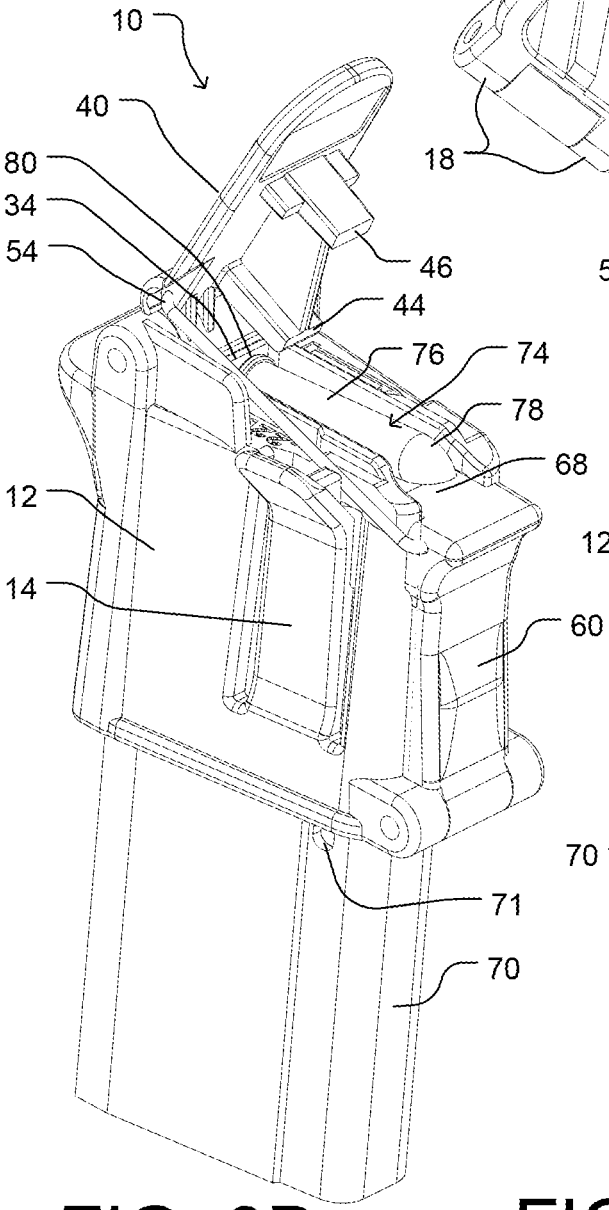
FIG. 3B is a perspective top left side view of the loader adapted and fitted on a PMR/CMR type magazines shown with its press in an 'up' position and a top round in place.
Figure 3C:
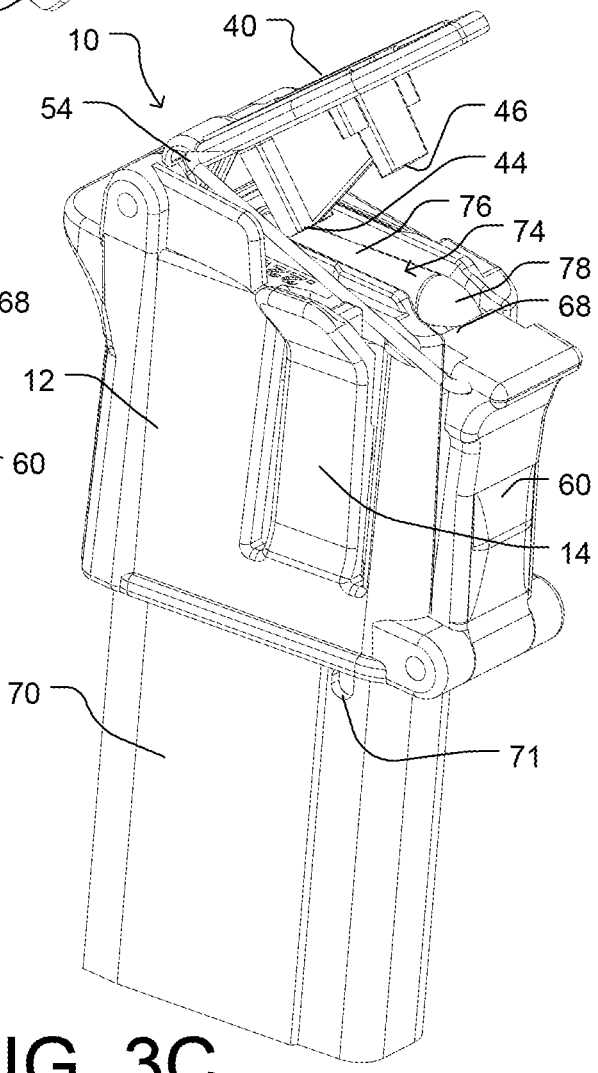
FIG. 3C is a perspective top left side view of the loader fitted to the magazine with its press in a tilted 'mid' position.

FIGS. 3A-3C—Perspective Views

FIG. 3A is a perspective bottom view of the loader showing lock tooth 16 extending inward in the body and showing unloading tooth 30. Inner ribs (not numbered) are provided in the body for magazine alignment.

FIG. 3B shows the loader fitted on the top open-side of a PMR/CMR magazine 70. FIG. 3B shows one of several witness holes 71 in the magazine. Lock tooth 16 clicks into preferably an uppermost witness hole in the magazine, shown best in FIGS. 4B, 5A, and 5B, thereby locking the loader to the magazine. Press 40 is shown in its uppermost position, front pusher 60 is adjacent the body, and a top round 74 is positioned fully rearwardly in the magazine's upper opening 32 (FIG. 1C; not numbered in FIG. 3B). In this position rim or closed end 80 of case 76 of the round engages rear side 34 of opening 32 and rests on the magazine's follower or on an uppermost round in the magazine, not shown nor numbered. A bullet 78 of round 74 rests on top of tongue 68 with the bullet-pushing surface 64 below it. The bullet extends forward few millimeters over tongue 68. The rim-side of the round is somewhat lower than the bullet end, hence the round is slightly angled.

FIG. 3C shows the press tilted down somewhat until rear plunger tooth 44 engages case 76 of round 74. Pusher 60 and its tongue 68 are thus tilted somewhat further from the body via wire 54. At this press and pusher position the bullet still rests on tongue 68, at a location closer to its tip.

FIGS. 4A-4B—Perspective Views

FIG. 4A is a perspective top left side view of the loader coupled to the magazine with its press 40 pushed down to its fully down position, so that coupling wire 54 pushes front pusher 60 to its maximum tilt away from the body. Rear plunger 44 (FIG. 3B) on the underside of press 40 has pushed the rear of case 76 of round 74, near rim 80, further down into the magazine and front plunger 46, also on the underside of the press, has pushed the opposite side of the case somewhat down. Bullet 78 has now disengaged from tongue 68 of pusher 60 as the pusher has tilted further away from the body. The bullet now rests on the top edge 70F of the magazine's front wall (FIG. 5B). Hence, rim 80 and case 76 of the round are substantially in the magazine and are positioned lower than and slightly in front of magazine lips 72, and have shifted somewhat to either left or right side of the magazine where there was sufficient (alternating) vacant space formed in said staggered magazine. The rim and case are held in place by one of two flaps 73 of the magazine's upper open side. Flaps 73 are somewhat unique to this magazine since they act as miniature or sub lips capable of holding the topmost round temporary in place in the magazine just in front of one of the two lips 72. The tip of the bullet is adjacent or touching bullet pushing surface 64.

FIG. 4B is a perspective top rear side view of the loader, less its body for description, with press 40 in the up-most position. Pusher 60 has now been drawn back by wire 54 so that bullet pushing surface 64 of tongue 68 has pushed round 74 fully rearward below one of two lips 72 of magazine 70 to its final position.

As stated, when the loader is fitted onto the magazine the loader's tooth 16 (FIG. 3A) is designed and positioned to snap into the top one of holes 71 in the magazine in order to lock the loader onto the magazine.

FIGS. 5A-5B—Perspective Views

FIG. 5A is another perspective top left side view of the loader on the magazine with press 40 in the fully up position. The loader's body is omitted to enable viewing the inside details. A new round 74 is placed in the loader and plungers 44 and 46 under press 40 are clear of case 76 of the round. The bullet rests on and extends over tongue 68 of pusher 60, which is adjacent the body (not shown). Rim 80 of the round is positioned (by the rear side 34 of opening 32, not shown) just forward of the front edges of lips 72 of the magazine and rests on the follower (not shown) or the top round (not shown) in the magazine. The round is slightly angled up and is mostly above lips 72 and flaps 73 of the magazine, as also illustrated in FIG. 3B.

FIG. 5B is another perspective top left side view of the loader on the magazine with its press 40 in fully 'down' position (omitting the body), similar to FIG. 4A. Again, at this state, press 40 and plungers 44 and 46 are at their lowermost position, having pushed case 76 of the new round further into the magazine. The bullet has dropped down about 4-5 mm from tongue 68 to rest on edge 70F of the front side wall of the magazine and slightly extending forward from it. Pusher 60 is shown tilted furthest away from the body (not shown). Rim 80 and round are substantially in the magazine yet are still positioned just forward of lips 72. The round has shifted right or left and is held in place by one flap 73 of the magazine partly covering the case of the round.

Operation—FIGS. 3B-5B

The loader can be used to easily, quickly, and painlessly load ammunition rounds into a PMR/CMR-30 or similar magazine. Assume that the loader is in its open state, where front pusher 60 is pressed in, against the loader's body, and press 40 is moved up as shown in FIGS. 2A, 3B, and 5A. The user first orients and slides loader 10 (FIG. 3B) down on magazine 70 where lock tongue 14 flexes out until its lock tooth 16 (FIG. 3A) clicks in the top one of holes 71 (FIG. 4B) of the magazine, locking the loader to the magazine (FIG. 3B). Although FIG. 3B shows a round 74, assume that no round is yet in the loader.

The loader will remain stably in either its open or closed state. If the loader is initially in its closed state, where press 40 is pushed down and pusher 60 is moved out, away from the body as shown in FIG. 2C, the user can move it to its open state before assembling it to a magazine. To move the loader to its open state, the user uses a thumb (not shown) to open the loader by pressing pusher 60 towards body 12 to move press 40, via coupling wire 54, to its upmost position.

Assuming the loader is initially open, or has been opened by the step of the previous paragraph (FIG. 2A), the user preferably keeps a thumb on pusher 60 and inserts a new round 74 (FIG. 3B) into opening 32 of the body, rim end 80 first, until it moves onto the magazine and engages the opening's rear side 34. Bullet 78 rests atop tongue 68 of pusher 60. The round is now in an initially inserted position.

The user then uses a finger (not shown) to move press 40 down. At first, when press 40 moves partly down (FIG. 3C), rear plunger 44 pushes down the rim end of the round first so that the rim end of the round slides down along rear side 34 of opening 32. As the rim end moves down, it moves the magazine's follower, or any previously-loaded rounds and the follower, down. The round is now in a partly inserted position in the magazine. Also, as the press moves down, it pushes wire 54 forward so that it forces the top end of pusher 60 and its tongue 68 away from the body and out from under the bullet.

As the user moves press 40 further down, plunger 46 engages the upper or bullet end of case 76, pushing it down somewhat (FIG. 5B). Thereby both plungers 44 and 46 are engaging the case of the round and tongue 68 has moved forward, away from under bullet 78. The bullet will then step or drop down from its partly inserted position above tongue 68 to rest atop edge 70F of the front wall of the magazine (FIG. 5B). The round is now fixed at an angle in an intermediate partly inserted position with its bullet resting atop edge 70F of the magazine's front wall and the rim of the bullet in a lower position in the magazine. In this position, the rim of the round is just lower than and in front of lips 72 of the magazine, and the round as whole is temporarily and alternatingly held by either the left or the right flaps 73 as it will have shifted sideways slightly to a vacant space formed below a flap as the round pushed down previously loaded rounds further into the magazine.

When the first round drops or is pushed down into the magazine, it aligns on one side of the magazine (not shown) because the one side of the upper surface of the follower (not shown) is deeper than the other. Each subsequent round drops down on alternatingly opposite sides of the magazine to form two columns because the last previously loaded round is on one side or the other and thereby forms a receiving vacant space on the opposite side.

The user's force on press 40 is multiplied or leveraged on the round because pushing plunger 44 is closer to the axis of rotation pin 52 of press 40 than the actual user's pressing point on the upper surface of the press—which is commonly further up the press. Hence, using the loader to push in rounds is easier than manual loading or loading with any prior-art loader because of leverage.

Lastly, the user pushes pusher 60 back in with the thumb and simultaneously releases finger pressure on the press, causing bullet-pushing surface 64 of tongue 68 to push the bullet and hence the round back to a fully inserted position. When the round is pushed back, the tip of the bullet slides off top edge 70F of the magazine and the round moves fully below flap 73 and lip 72 into its rear-most and fully inserted position in the magazine. The round is now held in place by both lip 72 and flap 73 along either left or right side of the magazine, as illustrated in FIG. 4B. The loader is now in its open position again, but with a round fully inserted into the magazine.

The user repeats these steps for loading additional rounds. The following is a brief summary of the steps:

1. Loader Open: If loader is initially closed, the user opens it by pressing pusher 60 toward body to open the loader and tilt press 40 upward, as shown in FIG. 3B.

2. Round Initially Inserted: After the loader is opened, or is initially open, the user inserts a new round, rear or rim end first, into opening 32 and onto the magazine where the bullet rests on tongue 68 of pusher 60. The round is initially inserted.

3. Round Intermediately Inserted: Then the user releases pressure on pusher 60 and pushes press 40 down, thereby pushing the rim end of the round further down into the magazine while simultaneously moving the pusher away from the body to allow the bullet to drop down from tongue 68 to rest atop edge 70F of the magazine. The round is now in an intermediate partly inserted position below a flap 73 of the magazine.

4. Round Fully Inserted: The user releases pressure on press 40 and forces pusher 60 back toward the body and opens press 40. The free end surface 64 of tongue 68 pushes the tip of the bullet and hence the round rearward into its fully inserted rear position below a lip and flap of the magazine.

5. Repeat To Load Rest of Rounds: The user continually repeats the last three steps until the magazine is fully loaded with rounds. With some practice, the user can load rounds quickly and easily by repeatedly cycling from open to round fully inserted positions, until the magazine is full.

Use of the loader eliminates the need to load up to 30 rounds with bare-fingers under increasing manual force from the spring in the magazine. Thus, the loader eliminates fatigue and accumulated finger pain.

To remove the loader from the magazine, the user simply (a) pulls with one hand the top side of lock tongue 14 outward to disengage lock tooth 16 from the magazine's top witness hole 71, and (b) pushes and slides the loader upward away from the magazine with the other hand.

CONCLUSION, RAMIFICATIONS, AND SCOPE

The reader will see that we have provided a magazine loader that can be locked to the magazine for stability and reliable operation. It has two easily operable members which use leverage. It provides a valuable aid to load magazines of the type which have feed lips or feed lips with retaining flaps. The user can load multiple magazines without any thumb pain associated with directly repeatedly pushing new rounds into the magazine. The loader comprises few parts, is highly reliable, comfortable to use, palm-sized, light weight, and simple to operate.

While the above description contains many specificities, the reader should not construe these as limitations on the scope but rather as an exemplification of several embodiments thereof. Other ramifications and variations are possible within the teachings.

Some exemplary ramifications are as follows: The loader described can be altered to fit other magazines and calibers, provided a suitable change in dimensions and construction is made in the loader to suit a magazine. The loader and its components may be made of separate and or different plastic materials, or, alternatively, of other materials, such as aluminum or steel, and any combination thereof. All numerical values provided are approximate; they can be changed to adapt to other magazines or round types and or calibers. Coupling wire 54 can be supplemented with an additional coupling wire on the other side, or by lever arm(s). The shapes of plungers 44 and 46, as well as all other parts, can be changed to other configurations. The press may have just one plunger extending therefrom for pushing a round down. The loader may be useable on magazines without retaining flaps.

Accordingly, the scope should be determined, not by the embodiments illustrated, but by the appended claims and their legal equivalents.

The invention claimed is:

1. A magazine loader for facilitating the loading of rounds into a predetermined firearm magazine having (1) an open upper end and which holds one or more columns of rounds therein and urges said rounds to, and feeds said rounds from, said open end of said magazine, (2) a plurality of side walls extending down from said open end, including parallel front and back walls, and a spring-urged follower for pushing any rounds in said magazine that are above said follower to said open end, (3) a pair of feed or retaining lips having a predetermined spacing therebetween at said open end, and (4) at least one magazine catch, said loader comprising:

(a) a body or holder having an opening at its bottom side and shaped to fit onto said open upper end of said magazine, said body or holder having front and back walls and two connecting said walls, (b) body-locking or attaching means for removably attaching said body or holder to said magazine, (c) a manually operable press comprising a member having a pair of opposite ends, a proximal end being hinge-coupled to a top end of said body or holder adjacent said back wall, said press having an up position where it extends up from above and is angled to said open end of said magazine so that its opposite or distal end is relatively far from said body or holder, and a down position where said distal end is relatively close to said body or holder, said press having a pair of opposite sides, one of which is an upper side facing away from said open end of said magazine and one of which is an underside facing said open end of said magazine, (d) said press having a plunger or tooth that extends from said underside of said press and has a free bottom end, said free bottom end being positioned above said open end of said magazine when said press is in said up position and positioned in said open end of said magazine when said press is in said down position, such that when a round is placed onto said open upper end of said magazine, in an initial position, and said press is manually pivoted from said up position to said down position, said free bottom end of said plunger will engage and push down said round to a partly inserted position, (e) a manually operable pusher comprising a member having a pair of opposite ends, one of which is a lower end that is hinge-coupled to a lower end of said body or holder adjacent of said front wall, said pusher having an open position where it extends away from and is angled to said front wall of said body or holder so that its opposite, upper end is relatively far from said front wall and a closed position where said upper end is relatively close to said front wall, said pusher having a pair of opposite sides, one of which is an outer side facing away from said front side and one of which is an inner side facing said front side, (f) said pusher having a tongue that extends from said inner side of said pusher adjacent said upper end, said tongue having a free end, so that (1) when said pusher is in a closed position, said tongue will underlie one end of a partly inserted round, (2) when said pusher is moved to said open position, said free end of said tongue will move out from said one end of said partly inserted round and allow said one end to move down, and (3) when said pusher is moved back to said closed position, said free end of said tongue will engage said one end of said partly inserted round and push it to a fully inserted position in said magazine and (g) means coupling said press to said pusher so that (1) movement of said press from said up position to said down position will simultaneously move said pusher from said closed position to said open position to cause said tongue of said pusher to move out to allow said opposite end of said partly inserted round to be pushed down by said plunger, and (2) movement of said pusher from said open position to said closed position will move said press from said down position to said up position and cause said tongue of said pusher to push said round from said partly inserted position to a final and fully inserted position, whereby said rounds can be loaded into said magazine with reduced effort by placing a round onto said open end of said magazine to an initially inserted position, pushing said press down to move said pusher to said open position and push said round down to said partly inserted position, and pushing said pusher in to move said press back to said open position and push said partly inserted round rearward to a final and fully inserted position in said magazine.

2. The magazine loader of claim 1 wherein said press has an additional plunger or tooth extending from said pusher so that said press has two plungers or teeth extending therefrom, a proximal one of which is adjacent said proximal end of said press and the other of which is a distal one and is positioned adjacent said distal end of said press, said plungers each having a free bottom end, said free bottom ends of said plungers being positioned above said open end of said magazine when said press is in said up position and positioned in said open end of said magazine when said press is in said down position, such that when a round is initially inserted onto said open upper end of said magazine and said press is manually pivoted from said up position to said down position, said free bottom end of said proximal plunger will engage and push down against one end of said initially inserted round in said magazine and said distal plunger will push down against an opposite end of said round.

3. The magazine loader of claim 2 wherein said two plungers or teeth are connected by a support rib.

4. The magazine loader of claim 2 wherein said proximal plunger or tooth is longer than said distal plunger or tooth.

5. The magazine loader of claim 1 wherein said means coupling said press to said pusher comprises a wire having two ends that extend through respective holes in said press and said pusher.

6. The magazine loader of claim 5 wherein said hole in said pusher is adjacent said proximal end of said press and said hole in said pusher is adjacent said distal end thereof.

7. The magazine loader of claim 1 wherein said body-locking or attaching means comprises an elastic lock tongue on the outside of a side of said body or holder and which has a projecting tooth attached to a side of said tongue, said tooth extending into the inside of said body or holder and spaced to mate with a witness hole in said magazine.

8. The magazine loader of claim 1, further including stop means for limiting the extent of the downward rotation of said press.

9. The magazine loader of claim 8 wherein said stop means comprise a block adjacent said plunger or tooth.

10. The magazine loader of claim 1 wherein (a) said press has an additional plunger or tooth extending from said pusher so that said press has two plungers or teeth extending therefrom, a proximal one of which is adjacent said proximal end of said press and the other of which is a distal one and is positioned adjacent said distal end of said press, said plungers each having a free bottom end, said free bottom ends of said plungers being positioned above said open end of said magazine when said press is in said up position and positioned in said open end of said magazine when said press is in said down position, such that when a round is initially inserted onto said open upper end of said magazine and said press is manually pivoted from said up position to said down position, said free bottom end of said proximal plunger will engage and push down against one end of said initially inserted round in said magazine and said distal plunger will push down against an opposite end of said round, and (b) said means coupling said press to said pusher comprises a wire having two ends that extend through respective holes in said press and said pusher.

11. A magazine loader for facilitating the loading of rounds into a predetermined firearm magazine having (1) an open upper end and which holds one or more columns of rounds therein and urges said rounds to, and feeds said rounds from, said open end of said magazine, (2) a plurality of side walls extending down from said open end, including parallel front and back walls, and a spring-urged follower for pushing any rounds in said magazine that are above said follower to said open end, and (3) a pair of feed or retaining lips having a predetermined spacing therebetween at said open end and a pair of flaps extending from said retaining lips, said flaps having a predetermined spacing therebetween greater than said spacing between said feed lips, and (4) at least one magazine catch, said loader comprising:

(a) a body or holder having an opening at its bottom side and shaped to fit onto said open upper end of said magazine, said body or holder having front and back walls and two connecting said walls, (b) body-locking or attaching means for removably attaching said body or holder to said magazine, (c) a manually operable rounds depressor holder comprising a member having a pair of opposite ends, a proximal end being hinge-coupled to a top end of said body or holder adjacent said back wall, said rounds depressor holder having an up position where it extends up from above and is angled to said open end of said magazine so that its opposite or distal end is relatively far from said body or holder, and a down position where said distal end is relatively close to said body or holder, said rounds depressor holder having a pair of opposite sides, one of which is an upper side facing away from said open end of said magazine and one of which is an underside facing said open end of said magazine, (d) said rounds depressor holder having a pair of rounds depressors that extend from said underside of said rounds depressor holder and have free bottom ends, a proximal one of said rounds depressors being closer to said proximal end of said rounds depressor holder and distal one of said round depressors being closer to said distal end of said rounds depressor holder, said free bottom ends of said round depressors being positioned above said open end of said magazine when said rounds depressor holder is in said up position and positioned in said open end of said magazine when said rounds depressor holder is in said down position, such that when a round is initially inserted onto said open upper end of said magazine and said rounds depressor holder is manually pivoted from said up position to said down position, said free bottom end of said proximal rounds depressor will engage and push down against one end of said initially inserted round on said magazine and said distal rounds depressor will push down against an opposite end of said initially inserted round, (e) a manually operable pusher comprising a member having a pair of opposite ends, one of which is a lower end that is hinge-coupled to said body or holder adjacent a lower end of said front wall, said pusher having an open position where it extends away from and is angled to said front wall of said body or holder so that its opposite, upper end is relatively far from said front wall and a closed position where said upper end is relatively close to said front wall, said pusher having a pair of opposite sides, one of which is an outer side facing away from said front side and one of which is an inner side facing said front side, (f) said pusher having a tongue that extends from said inner side of said pusher adjacent said upper end, said tongue having a free end so that (1) when said pusher is in a closed position, said tongue will underlie one end of said initially inserted round, (2) when said pusher is moved to said open position, said free end of said tongue will move out from said one end of said initially inserted round and allow said one end to move down to a partially inserted position, and (3) when said pusher is moved back to said closed position, said free end of said tongue will engage said one end of said round and push it to a fully inserted position in said magazine and (g) means coupling said rounds depressor holder to said pusher so that (1) movement of said press from said up position to said down position will simultaneously move said pusher from said closed position to said open position to cause said tongue of said pusher to move out to allow said opposite end of said round to be pushed down by said distal rounds depressor, and (2) movement of said pusher from said open position to said closed position will move said rounds depressor holder from said down position to said up position and cause said tongue of said pusher to push said round from said partially inserted position to a final and fully inserted position, (h) whereby said rounds can be loaded into said magazine with reduced effort by inserting a round onto said open end of said magazine to said initially inserted position, pushing said rounds depressor holder down will move said pusher to said open position and push said round down to said partially inserted position, and pushing said pusher in will move said rounds depressor holder back to said open position and push round rearward to a final and fully inserted position in said magazine.

12. The magazine loader of claim 11 wherein said pair of rounds depressors are connected by a support rib.

13. The magazine loader of claim 11 wherein said proximal rounds depressor is longer than said distal rounds depressor.

14. The magazine loader of claim 11 wherein said means coupling said rounds depressor holder to said pusher comprises a wire having two ends that extend through respective holes in said press and said pusher.

15. The magazine loader of claim 14 wherein said hole in said pusher is adjacent said proximal end of said rounds depressor holder and said hole in said pusher is adjacent said distal end thereof.

16. The magazine loader of claim 11 wherein said body-locking or attaching means comprises an elastic lock tongue on the outside of a side of said body or holder and which has a projecting tooth attached to a side of said tongue, said tooth extending into the inside of said body or holder and spaced to mate with a witness hole in said magazine.

17. The magazine loader of claim 11, further including stop means for limiting the extent of the downward rotation of said rounds depressor holder.

18. The magazine loader of claim 17 wherein said stop means comprise a block adjacent said one of said rounds depressors.

19. The magazine loader of claim 11 wherein (a) said body-locking or attaching means comprises an elastic lock tongue on the outside of a side of said body or holder and which has a projecting tooth attached to a side of said tongue, said tooth extending into the inside of said body or holder and spaced to mate with a witness hole in said magazine, and (b) said means coupling said rounds depressor holder to said pusher comprises a wire having two ends that extend through respective holes in said rounds depressor holder and said pusher.

20. The magazine loader of claim 11 wherein said proximal rounds depressor is longer than said distal rounds depressor, and further including stop means for limiting the extent of the downward rotation of said rounds depressor holder.

* * * * *